United States Patent [19]

Egli et al.

[11] 3,974,972

[45] Aug. 17, 1976

[54] APPARATUS FOR FORMING A RESERVE WINDING ON A YARN SPOOL

[75] Inventors: Emil Egli, Windisch, Switzerland; Hans Landwehrkamp, Lenting, Germany

[73] Assignee: Schubert & Salzer Maschinenfabrik Aktiengesellschaft, Ingolstadt, Germany

[22] Filed: June 26, 1974

[21] Appl. No.: 483,390

[30] Foreign Application Priority Data

June 26, 1973 Germany ..... 2332327

[52] U.S. Cl. ..... 242/18 PW; 242/18 DD; 242/19

[51] Int. Cl.[2] ..... B65H 54/02

[58] Field of Search ..... 242/18 PW, 18 R, 18 DD, 242/19, 43 A, 43

[56] References Cited

UNITED STATES PATENTS

| | | | |
|---|---|---|---|
| 2,481,031 | 9/1949 | McDermott | 242/18 PW |
| 2,706,089 | 4/1955 | Griset, Jr. | 242/18 R |
| 2,870,971 | 1/1959 | Keith | 242/18 PW |
| 3,030,039 | 4/1962 | Roberts | 242/18 PW |
| 3,224,692 | 12/1965 | Nugent | 242/18 PW |
| 3,374,961 | 3/1968 | Otsuka et al. | 242/43 |
| 3,672,582 | 6/1972 | Allam et al. | 242/18 R |
| 3,690,576 | 9/1972 | Schroeder | 242/18 DD |
| 3,791,126 | 1/1974 | Kose et al. | 242/18 R |
| 3,801,030 | 4/1974 | Kobatake et al. | 242/18 R |
| 3,816,990 | 6/1974 | Hoffman et al. | 242/18 DD |

*Primary Examiner*—Stanley N. Gilreath
*Attorney, Agent, or Firm*—Robert W. Beach; R. M. Van Winkle

[57] ABSTRACT

A thread-control tool has a notch for receiving a yarn stretch and holding it between the jaws of a cutter having a fixed blade and a movable blade on one arm of a bell crank. When a full spool is removed, the supply yarn stretch is seized by a thread-holding notch in the tool, the thread is severed, and the supply stretch severed end is fed to a suction port to be held and tensioned while the full spool is exchanged for an empty spool core. The thread-control tool then seizes the thread stretch adjacent to the suction port and carries the thread to one end of the empty spool. A wedging element on the tool wedges apart the spool end and its end-supporting plate to form a slot and to insert a portion of the supply stretch into the slot. As the wedge is moved out of the slot, the slot closes and the thread is clamped. The thread beyond the clamped portion is severed, and the cut off end portion is carried away through the suction port. Rotation of the spool core effects a few reserve turns until the thread is inserted in the traversing thread guide.

7 Claims, 6 Drawing Figures

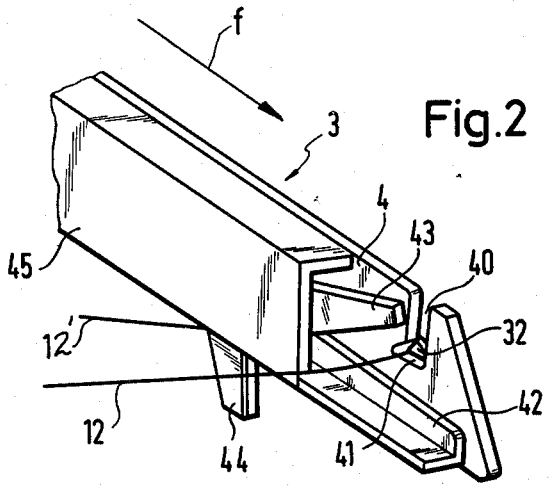
Fig.2
Fig.3
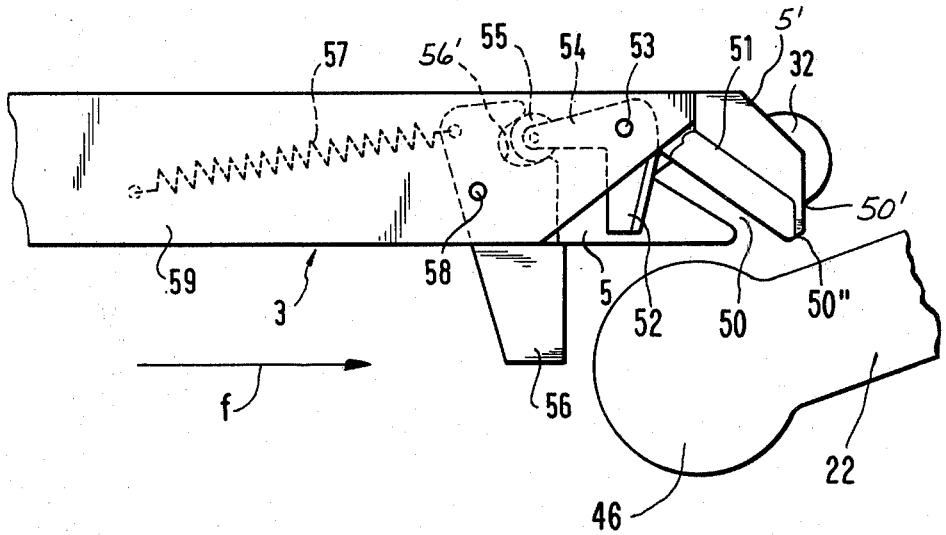

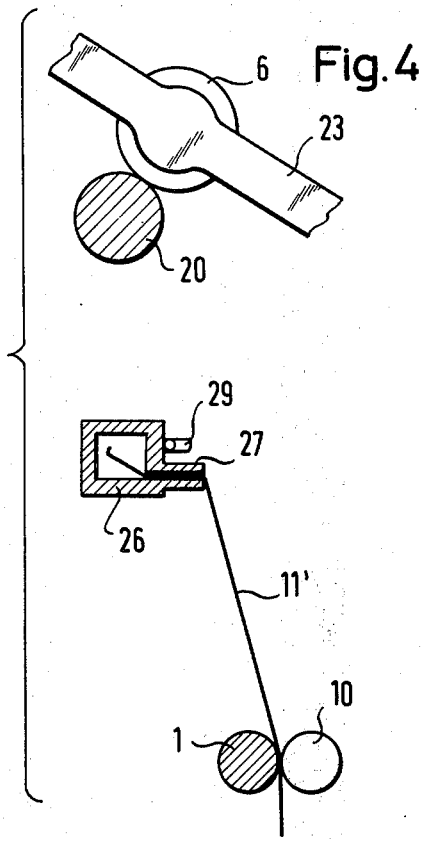
Fig.4
Fig.5
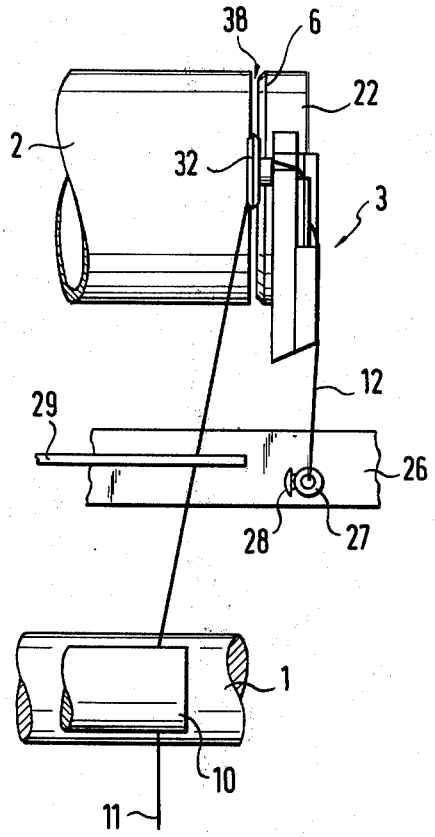
Fig.6
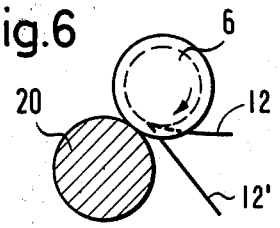

APPARATUS FOR FORMING A RESERVE WINDING ON A YARN SPOOL

The present invention relates to a method and apparatus for forming reserve windings on an empty spool core placed in a spool holder and rotated by a spool roller.

It is conventional to form a yarn reserve on a spool core of a textile machine as disclosed in British Pat. No. 1,371,955. In such prior arrangements two yarn clamp jaws are provided on a spool holder above the end of an empty spool core one of which yarn clamp jaws being spring pressed against the other jaw. For forming a yarn reserve the thread is clamped between these two yarn clamp jaws and partially wound around the connecting pin between the two yarn clamp jaws and is simultaneously thrown around the core-holding cone. As the core turns yarn is drawn simultaneously from the yarn supply and from the previously formed spool until the service person interrupts the reserve formation by severing the yarn leading to the completed spool. Such devices are adequate for slow winding speeds and small spools, but at higher speeds the service person has great difficulty effecting the changeover, and, in fact, it is often impossible for him or her to hold the heavy filled spool in a manner such that the reserve yarn can be drawn from the spool. In addition, the previous methods for providing a reserve winding have required special spool cores having roughened or ribbed surfaces.

It is the principal object of the present invention to provide a simple and convenient method for forming a reserve winding which can be effected reliably at high spool-forming speeds and without necessity for special spool cores.

It is also an important object to provide simple, economical apparatus to facilitate practicing the method of the present invention.

The foregoing objects can be accomplished by disengaging the full spool and the spool drive, cutting the thread between the thread supply and the full spool, guiding the severed end from the thread supply to a thread-holding device, and removing the full spool. After replacing the full spool with an empty spool core and engaging the core with the spool drive, the thread stretch between the thread supply and the thread-holding device is seized, pulled to the empty core and clamped between a core end and the adjacent core-supporting member which rotates with the core. After the thread is clamped, the portion of thread extending between the clamping location and the thread-holding device is severed at a fixed distance from the empty spool. It is preferred that the clamping operation be performed by wedging apart an end of the spool core and the adjacent supporting member to form a slot, inserting the thread in the slot and resiliently returning the separated members into contact. When winding occurs at high speed in apparatus in which the spool core is driven by a contact drive roller, it is especially advantageous to clamp the thread at the side of the spool core opposite the side engaged with the drive roller. By use of the method of the present invention, the clamped thread is rotated along with the spool core without the severed thread end being covered by the new winding.

Apparatus for practicing the method of the present invention includes a thread-holding device located near the path of thread supplied to the spool and a separate thread-control tool having a frame carrying a thread gripper and a thread cutter operable to cut the thread closely adjacent to the gripper. In the preferred form of the invention, the thread-holding device is an auxiliary drawoff device. A wedging member preferably is carried by the thread-control tool at a location spaced from the thread gripper, which wedging member can be pressed between one end of an empty spool and the rotatable core end supporting member. An especially suitable wedging member is formed as a wheel having a peripherally central ridge with the margins frustoconically tapered from the ridge toward the wheel axis.

The thread gripper is preferably formed as a notch, and the cutter is formed as shears in which the edge of the notch is sharpened to constitute a fixed cutting blade and one arm of a bell crank constitutes a cooperating movable cutting blade. The bell crank is held by a tension spring in a position by which the shears blades are held in normally open condition. The other bell crank arm is a shears-actuating arm engageable with an abutment, preferably located on the spool core holder, after the wedging member has entered the slot between the spool core and its rotating support member. It is also preferred that the thread-holding member is a suction port located close to but outside of the thread tension-regulating yoke. Such location of the suction port increases the assurance that tension on the thread will be substantially constant so that the thread will be under positive control throughout the spool-changing operation.

FIG. 2 is a top perspective of the working end of a modified form of thread-control tool.

FIG. 3 is a side elevation of the working end of a further modified form of thread-control tool.

FIG. 4 is a fragmentary end elevation of the spool holder and thread supply device with parts in section and parts broken away, showing parts in one stage of the spool changeover operation;

FIG. 5 is a front elevation of the apparatus shown in FIG. 4, showing parts in a different operative condition.

FIG. 6 is an end elevation of the spool holder showing the thread orientation upon roller rotation of about 90° beyond the initial thread-clamping position.

Figure 1:
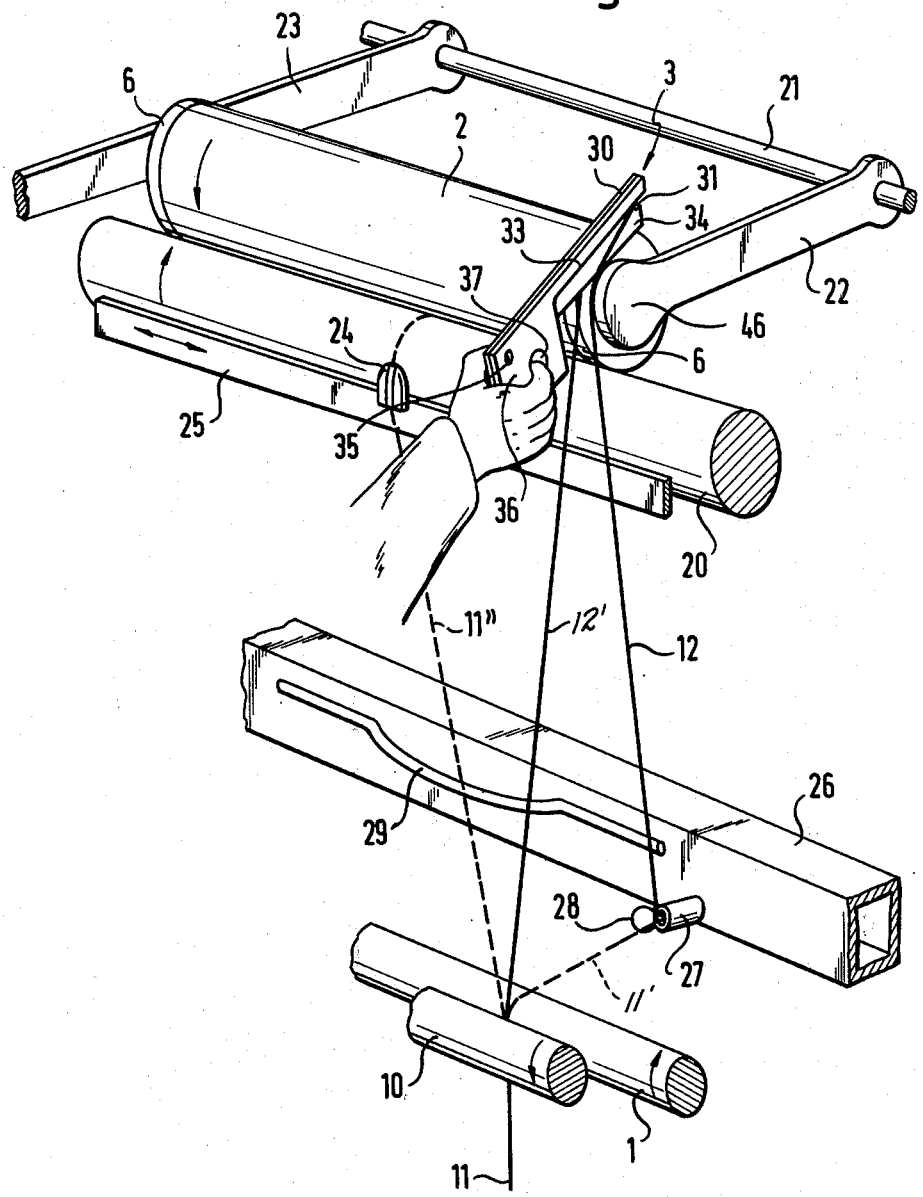
FIG. 1 is a top perspective of a spool holder and thread supply device, showing one embodiment of the present invention, parts being broken away.

The present invention can be applied to various textile machines including, for example, a yarn-winding machine or an open-end spinning machine. For simplicity the invention is illustrated for use with an open-end spinning machine, while brief reference is made in the following description to the most relevant differences in application to a yarn-winding machine.

In an open-end spinning machine, supply thread 11 is continuously drawn from a spinning chamber by drawoff rollers 1 and 10 and is wound onto a spool core 2. The spool core is rotated in the working position shown in the drawings by a friction spool drive roller 20 engageable with the spool core or the progressively outer turns of the thread winding onto the core. The spool core 2 is resiliently gripped between two spool holder arms 22 and 23, which arms are swingable about rod 21 to move away from spool drive roller 20 as the thread package is built up and to move the spool or package out of engagement with the spool drive roller when the package is completed. A thread guide 24 is carried by a traverse 25 is located in front of spool drive roller 20 so that the thread stretch 11'' extends from the nip of drawoff rollers 1,10, through a guide channel in thread guide 24, over the drive roller 20, and between the spool drive roller and the spool on core 2 during normal winding.

Between drawoff rollers 1,10 and spool drive roller 20, there is located a vacuum duct 26 from which projects a nipple forming a suction port 27 which can be closed by a cap 28. A thread-tensioning yoke 29 is preferably carried on the vacuum duct 26, over which yoke the thread stretch 11'' extends. 115 to A thread-control device 3 is shown in FIG. 1 as a hand tool. Tool 3 has a frame 30 on the working end of which is a thread-gripping notch 31. As shown in FIG. 1, the tool is used to grip the thread at one end of spool core 2. On the side of the frame opposite the spool core a thread cutter is provided having cutting blade 33 movable relative to a fixed cutting blade 34 which is formed on the edge of thread-gripping notch 31. The movable cutter blade 33 is formed on one arm of a bell crank lever swingable about pivot pin 35 carried by frame 30. The second bell crank arm 36 has a cutout 37 through which the fingers of the operator can extend, by which the cutter is operable.

When a full spool (not shown) is to be exchanged for an empty spool core 2, the full spool is lifted off by lifting up on the extension of spool holder arm 23 projecting forwardly of the spool to separate it from spool roller 20. The thread 11'' extending from drawoff rollers 1,10 to the spool is severed manually, such as by tearing or cutting. The severed end of the supply thread is guided into the suction stream of port 27 and is drawn into the port and held by the continuous suction force. The supply thread in this condition has a stretch 11' extending from drawoff rollers 1,10 to suction port 27, as shown in FIGS. 1 and 4. The full spool is then removed from the spool holder 22,23 and replaced by an empty spool core.

In the operation just described the spool was lifted away from roller 20 before severing the supply thread 11. Of course, such supply thread 11 could be severed and the supply end guided into the suction port 27 before the full spool is lifted from the spool roller 20.

After the full spool has been exchanged for an empty core 2 and the spool holder arm 23 is lowered so that the core engages drive roller 20, the thread 11' extending between drawoff rollers 1,10 and port 27 is seized by the thread-gripping notch 31 of thread-control tool 3. During the time in which the spool and spool core were being exchanged, the drawoff rollers 1,10 continued to supply thread which was drawn into suction port 27. That reserve thread is now raised by tool 3 to the empty core 2 and is inserted between the end of the core and the core end supporting member 6, which may be a cone or a chamfered core plate. For simplicity the invention is further described in connection with a core end support 6 having a cylindrical projection from support arm 22 terminating in a frustoconically-chamfered core-abutting portion, as shown in FIG. 5. The core end support 6 may be supported as an idler wheel on arm 22 so it can rotate with core 2.

In the above description the severed supply thread 11' extended directly from the nip of rollers 1,10 to the suction port 27. As the supply thread is drawn from port 27 by thread-control tool 3, it forms a return bend having one stretch 12' extending from rollers 1,10 to thread gripping notch 31, and a second stretch 12 extending from notch 31 to port 27.

As stated above, core end support 6 is chamfered so that a groove is formed between the core end and the body of support 6, into which groove the thread 12,12' is guided by tool 3 to be wedged into and clamped in the groove. As the core is rotated by roller 20, the thread 12' between the clamped portion and rollers 1,10 is wound onto spool 2. Thread 12' is thereby tensioned so that it is drawn across the path of the thread guide 24 carried by traverse 25. This thread guide 24 is a conventional self-threading guide so that thread 12' will be picked up during the traversing motion of the thread guide. Since the thread 12' is sufficiently tensioned to be drawn into the path of the thread guide only after several turns of the empty core 2, several reserve windings are formed on the end portion of core 2 which lies outside the stroke of thread guide 24, and therefore the reserve windings are not covered by subsequent normal windings.

The thread stretch 12 extending from tool 3 to suction port 27 is severed at a fixed interval from the clamping position of the thread by actuation of arm 36 to close shears blades 33,34 and the free thread piece is drawn off through port 27 and carried away by vacuum duct 26.

The above procedure can be varied. For example clamping of the thread stretch 12,12' can be facilitated by forming a slot 38 between core 2 and core end support 6 as shown in FIG. 5. For this purpose a wedging member 32 (see FIGS. 2, 3 and 5) is provided which projects beyond the edge of frame 30 opposite the frame edge in which the thread-gripping notch opens. As shown best in FIG. 5, the wedging member is preferably constructed as a roller so that it can be rotated by engagement with the end of core 2 and support 6 instead of dragging on the rotating members. The roller 32 has a central ridge on its periphery, the peripheral margins on opposite sides of the ridge being frustoconically tapered toward the roller axis. Wedging roller 32 is preferably located on the lateral side of frame 30 adjacent to core 2, as shown in FIGS. 2, 3 and 5. Since the spool holder arm 22 is conventionally resiliently pressed toward core 2 but is movable in the opposite direction to permit removal of a spool from the holder, the wedging wheel when inserted in the groove between core 2 and the core end support 6 formed by the chamfered support ends can spread the core end and the support 6 to form a slot 38 into which thread 12,12' can be inserted. Such thread will be tightly and positively clamped in the slot as the wedging roller 32 is rolled traversely of the spool axis and out of the wedged groove.

During low speed winding operations it makes no substantial difference whether the reserve winding is formed with the spool core 2 rotating at its idling speed or at winding speed. However, for high-speed winding operations it is necessary that the reserve winding be formed with the spool core running at winding speed; otherwise the stretch of thread 11' produced by the speed of the delivery rollers 1,10 would result in a slack which could not be taken up by the winding core and it would be impossible to produce evenly wound spools. In order to assure that rotation of spool core 2 is not interrupted by inadvertently lifting the core off the spool drive roller 20 during a reserve winding operation, the thread-control tool 3 is moved into the clamping position from the side of the spool core axis opposite the drive roller 20, so that the wedging force is applied in a direction to press the spool core and spool holder toward the drive roller. Consequently, when the drive roller 20 is below the axis of the spool core 2, the thread 12,12′ is moved from above core 2 and end support 6 downward as shown in FIG. 1. Conversely, if roller 20 were arranged above the spool core axis, the supply thread would be moved upward from below the spool core axis.

While the clamping location has been shown at the end of core 1 adjacent to resilient spool holder arm 22, the clamping location could be at the opposite core end adjacent to rigid spool holder arm 23. The above-described clamping operation can be performed in winding apparatus in which the spool core is tapered and mounted on a single spool holder having a complementally tapered cantilever projection with a well-known detent latch to secure the spool core on the spool holder. The present invention can also be applied to a machine having a drive roller with conventionally crossing helical grooves as the traverse instead of a separate traverse 25 carrying thread guides 24.

As previously mentioned, the present invention can be used in textile machines other than an open-end spinning machine. For example, in yarn-winding machines the thread is not supplied to the spool, but rather the spool draws yarn from a spinner bobbin, cheese or other idle yarn source package as the spool is rotated. In such machines the thread is guided to a thread-holding device either before or after the spool holder is swung away from the drive roller. Since there is no independently running thread supply, the thread holder need not be an auxiliary take-up device, but may simply be a mechanical clamp. The thread 11′ which extends from the yarn source package to the thread-holding device is seized by the thread gripper of the thread-control tool 3 and drawn out from the yarn source package to the empty spool core 2 and clamped between the core end and its adjacent core end supporting member 6 as previously described. The thread extending from the thread-holding device to the spool core clamping location is severed by the shears carried on tool 3 in the manner previously described, and the empty spool core is subsequently swung into engagement with spool roller 20. Thereafter the severed thread piece can be automatically or manually removed from the thread-holding device.

The thread-control tool 3 can be constructed in various ways, and a modified construction is shown in FIG. 2. Frame 4 has a thread gripper in the form of slot 40 having an undercut portion 41 into which the thread 12,12′ seized by slot 40 slides, so that the thread is maintained more securely than in a straight slot. In this form of tool the stationary cutting blade 42 is provided near the frame edge opposite the edge through which slot 40 opens. A movable blade 43 is provided on one arm of a bell crank lever and is normally held in the open position shown in FIG. 2 by a spring (not shown). The other bell crank arm 44 forms the cutter-actuating arm. A cover or shield 45 is provided behind the working end of the tool 3.

A wedging wheel 32 is again provided to spread apart spool 2 and core end supporting member 6 to form a slot 38. When the tool is moved farther in the direction of arrow *f* transversely of the spool core axis, the wedging wheel slides out of slot 38 whereupon the slot closes and the thread is clamped. Cutter-actuating arm 44 is offset from wedging wheel 32 axially of the spool to be engaged with an abutment or stop carried by spool-holder arm 22 shown in FIG. 1 as the tool is moved out of wedging position. The end 46 of arm 22 may constitute the abutment, as indicated in FIG. 3. Engagement of the arm 44 with the abutment will swing the bell crank to move the cutter blade 43 into cutting relationship to blade 42 to sever the thread at a predetermined location beyond the clamped portion of the thread.

The tool shown in FIG. 3 operates in a similar manner. Frame 5 has a downwardly opening inclined slot 50 for seizing the thread. One side 51 of the slot forms a stationary cutting blade. The movable blade 52 is carried on one arm of the bell crank lever mounted on frame 5 by a pivot pin 53. the opposite bell crank arm 54 carries a roller 55 receivable in a claw 56′ of a cutter-actuating lever 56. A tension spring 57 connecting between the end of the actuating lever carrying claw 56′ and the frame 5 holds the lever in a position to maintain the movable cutter blade in open condition. Lever 56 is mounted on frame 5 by pivot pin 58. A shield or cover 59 protects the cutter-operating mechanism and the operator.

The wedging wheel 32 in this embodiment projects forwardly of the working end of tool 3 so that a shallow notch is formed between the wheel and the nose of the frame providing an auxiliary thread gripper. When thread stretch 11′ is to be pulled out, the thread is first seized by auxiliary notch 50′. When the nose 5′ of tool 3 is swung upwardly, the thread will then slide under the lip 50″ and into slot 50. In ohter respects the tool shown in FIG. 3 operates in the same manner as the tool of FIG. 2.

Other variations of the thread-control tool are possible in addition to those shown. For example, the wedging member could be a pin or a plate. The cutter could have two movable blades like a scissors, or it could have one movable blade engageable with an anvil. The cutter could be a circular blade carried on a common axle with wedging wheel 32.

It is preferred that the suction port 27 be located at the side of the thread-tensioning yoke 29, so that equal tension is constantly maintained in both stretches 12 and 12′ until stretch 12′ is picked up by thread guide 24. Such equalization of tension assures that the thread will be severed at a uniform distance from the clamping location, which might not be the case with respect to other possible placements of the suction port.

The tools shown in FIGS. 2 and 3 are especially suitable for an automatic method of operation. For this purpose tool 3 would be mounted on a carriage reciprocable along a track for movement of the tool successively from one station to another. The spool change would be effected in a known manner such as that disclosed in Czechoslovakian Pat. No. 129,436. A guide pin projecting from the carriage would catch thread stretch 11″ and carry it to the location of suction port 27, where the thread would be drawn away from the pin. A thread-severing device on the carriage closely following the guide pin could engage the thread portion between port 27 and the spool holder 22,23 to sever the thread from that portion wound on the spool. The severed end would be drawn into the port 27 and the vacuum duct 26 as shown in FIG. 4. After the full spool is removed, the spool core 2 is placed in the spool holder 22,23 and the spool core has been moved into engagement with drive roller 20, the working end of tool 3 could be moved along a curved path from a position below vacuum duct 26 first to seize thread stretch 11′ in the thread-gripping notch 40 or 50 and then to engage the wedging member 32 between the end of spool core 2 and supporting member 6, as shown in FIG. 5. As the wedging member rides through slot 38 formed by it, the cutter-actuating arm 44 (FIG. 2) or 56 (FIG. 3) will engage abutment 46 on spool holder arm 22 to sever the yarn beyond the clamping location. The tool would then be lifted above the spool holder and retracted for travel to the next station.

Instead of providing a single tool 3 on a carriage serving several spool holders, an individual tool 3 could be provided at each spool holder location while still being automatically operable.

We claim:

1. Apparatus for forming a reserve winding of thread from a supply source on a thread spool core having an end engageable with a core end supporting member carried by a spool holder and driven by a spool roller, such apparatus including thread-holding means adjacent to the path of thread between the supply source and the spool core and a frame having a working end which carries thread-gripping means for gripping a thread extending between said supply source and said thread-holding means and thread-cutting means adjacent to the thread-gripping means, the improvement comprising wedging means carried by the frame working end and movable into a position for temporarily wedging apart the spool core and the core end supporting member whereby a thread gripped by said thread-gripping means is inserted between said core and said core-supporting member, said wedging means being carried on the frame side adjacent to the spool core, and the cutting means being carried on the frame side opposite the spool core for severing a thread extending between said thread-gripping means and said thread-holding means.

2. The apparatus defined in claim 1, in which the wedging means is a roller having a peripheral ridge and a peripheral margin frustoconically tapered from said ridge toward the roller axis.

3. The apparatus defined in claim 1, in which the thread-gripping means is formed by a notch in the frame, and the cutting means includes a stationary cutting blade forming a side of said notch and a movable cutting blade movable relative to and cooperable with said stationary cutting blade for cutting thread held by said notch.

4. The apparatus defined in claim 3, and actuating arm means carried by the frame remote from said working end for moving the movable cutting blade into cutting position relative to the stationary cutting blade.

5. The apparatus defined in claim 4, and resilient means for normally holding the movable cutting blade away from the stationary cutting blade, and stop means engageable with the actuating arm means when the wedging means is moved out of its wedging position.

6. The apparatus defined in claim 5, in which the stop means is carried by the spool holder.

7. The apparatus defined in claim 1, further including means for traversing the thread along a spool winding path and thread-tensioning yoke means between the thread-supply source and the spool core for equalizing the thread tension along said winding path, the improvement further comprising the thread-holding means being located close to the thread-tensioning yoke, but outside the winding path effected by said traversing means.

* * * * *